US007183529B2

(12) United States Patent
Baek et al.

(10) Patent No.: US 7,183,529 B2
(45) Date of Patent: Feb. 27, 2007

(54) OVER-THE-RANGE MICROWAVE OVEN THAT GUIDES AIR TO A SUCTION PORT

(75) Inventors: Seung Jo Baek, Gyeonggi-Do (KR); Sang Bum Sohn, Seoul (KR); Je Jun Lee, Seoul (KR); Sung Bae Song, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/324,335

(22) Filed: Jan. 4, 2006

(65) Prior Publication Data

US 2006/0175322 A1 Aug. 10, 2006

(30) Foreign Application Priority Data

Feb. 5, 2005 (KR) ..... 10-2005-0011004

(51) Int. Cl.
*H05B 6/80* (2006.01)
*F24C 15/20* (2006.01)

(52) U.S. Cl. ..... 219/757; 219/681; 126/229 R

(58) Field of Classification Search ..... 219/757, 219/756, 681, 400; 126/21 A, 299 R, 299 D
See application file for complete search history.

(56) References Cited

U.S. PATENT DOCUMENTS 4,184,945 A * 1/1980 Morgan et al. ..... 219/757

6,621,058 B1 * 9/2003 Kim ..... 219/757

* cited by examiner

*Primary Examiner*—Philip H. Leung
(74) *Attorney, Agent, or Firm*—Birch, Stewart, Kolasch & Birch, LLP

(57) ABSTRACT

An over-the-range (OTR) microwave oven includes a main body installed above a cooking source of a gas range and has therein a cavity and an electric equipment chamber in which a magnetron is located. An air exhaust path is installed inside the main body and provides a path through which air generated from the cooking source which is introduced through a suction port formed at the bottom of the main body by a suction force of a blower installed at the main body is exhausted to the outside of the main body. An airstream guide path is installed inside the main body and provides a path through which air inside the electric equipment chamber is discharged to a front end portion of the bottom of the main body by a flow generating apparatus installed inside the electric equipment chamber in order to guide air from the cooking source to the suction port, so that delightfulness of a cooking environment is obtained by blocking air containing cooking by-products which used to flow toward the face of the cook, thereby improving product reliability and competitiveness.

18 Claims, 7 Drawing Sheets

OVER-THE-RANGE MICROWAVE OVEN THAT GUIDES AIR TO A SUCTION PORT

BACKGROUND OF THE INVENTION

1. Field of the Invention

The present invention relates to an Over-the-Range microwave oven, and particularly, to an Over-the-Range microwave oven having a flow passage structure preventing heat, steam and air containing cooking by-products generated from a cooking source of a gas range from being spread to the front of a cook.

2. Description of the Background Art

In general, an Over-the-Range (OTR) microwave oven is one of electric home appliances, which is installed on a wall surface of an upper space portion of a gas range installed in the kitchen, so as to be used to cook using microwave in a cavity and to suck/exhaust combustion gas and pollution air in the kitchen (i.e., performing a ventilation function) generated from the gas range installed under the OTR microwave oven using a blower installed therein.

FIG. 1 shows a typical type of the conventional OTR microwave oven, which will now be described as follows.

As shown in FIGS. 1 and 2, in the conventional OTR microwave oven 100, a cavity 1 for cooking by microwave energy and an electric equipment chamber 2 having a magnetron 3 for generating microwave energy therein are provided inside an outer casing 4, exhaust passages 5 are provided at the inside of the outer casing 4, that is, at one side of the cavity 1 and at one side of the electric equipment chamber 2, respectively, and a blower 6 is installed at an upper rear side of the outer casing 4.

A rotary tray (not shown) is rotatably installed inside the cavity 1 so as to rotate food received in the cavity 1.

An air suction port 7 communicating with the exhaust passage 5 is positioned at a lower side of the outer casing 4, and an air discharge port 8 for discharging air to the outside is formed on an upper surface of the outer casing 4. Here, according to user convenience, the air discharge port 8 is connected to a ventilating duct of a building and the like through a connection duct 8, or communicates with a plurality of discharge ports 11 formed on the entire upper surface of the outer casing 4.

In addition, a door 12 is installed at a front surface of the outer casing 4 in order to take food in or take it out of the cavity 1. Meanwhile, reference numeral 13 denotes a high voltage generator for supplying a high voltage to the magnetron 3.

The conventional OTR microwave oven having such a construction is installed above a gas range 200, and performs a hood function for ventilating smoke or smell generated when a user cooks using the gas range 200 as well as the original function of the microwave oven 200.

Hereinafter, an operation of the conventional ORT microwave oven will be described in brief.

First, the user opens the door 12 and puts food on the rotary tray in the cavity 1. The user then closes the door 12 and pushes an operation button of an operation panel (not shown). The rotary tray is rotated to thereby rotate the food thereon. At the same time, microwave is generated from the magnetron 3 and is induced into the cavity 1, such that the original function of the microwave oven, that is, cooking the food by the microwave energy, is performed.

In addition, when the user pushes a hood operation button on the operation panel, the blower 6 installed in the OTR microwave oven 100 is driven so as to generate a suction force, by which combustion gas and pollution air generated when the user cooks using the gas range installed under the microwave oven, in a direction indicated by an arrow of dotted line in FIG. 2, are sucked through the air suction port 7 formed at a lower surface of the outer casing 4. The sucked air is exhausted to the outside via the exhaust passages 5 through the air discharge port 8 formed at an upper surface of the outer casing 4, whereby the conventional OTR microwave oven serves as the hood for ventilating smoke or smell.

However, since the conventional OTR microwave oven has a structurally narrow air suction port 7 formed on the outer casing 4 and, as shown in FIG. 2, the air sucked by the air suction port 7 is exhausted to the outside through the right and left exhaust passages 5, the conventional OTR microwave oven has a structurally great fluid resistance. Accordingly, since the amount of air being sucked from the air suction port 7 is small, heat, steam and air including cooking by-products generated from a cooking source of the gas range 200 cannot be efficiently sucked through the air suction port 7. As a result, as illustrated in FIG. 3, the air which is not sucked through the air suction port 7 is spread to the front where a cook exists and directly reaches the cook, thereby causing the cook to feel unpleasant.

Accordingly, the conventional ORT microwave oven cannot maintain a pleasant environment for cooking in a kitchen, thereby deteriorating product reliability and competitiveness.

SUMMARY OF THE INVENTION

Therefore, an object of the present invention is to provide an Over-the-Range microwave oven having a flow passage structure preventing heat, steam and air containing cooking-by products generated from a cooking source of a gas range from being spread to the front of a cook.

To achieve these and other advantages and in accordance with the purpose of the present invention, as embodied and broadly described herein, there is provided an over-the-hood (OTR) microwave oven including: a main body installed above a cooking source of a gas range and having therein a cavity and an electric equipment chamber in which a magnetron is located; an air exhaust path installed inside the main body and providing a path through which air generated from the cooking source which is introduced through a suction port formed at the bottom of the main body by a suction force of a blower installed at the main body is exhausted to the outside of the main body; and an airstream guide path installed inside the main body and providing a path through which air inside the electric equipment chamber is discharged to a front end portion of the bottom of the main body by a flow generating apparatus installed inside the electric equipment chamber in order to guide air from the cooking source to the suction port.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Hereinafter, an Over-the-Range (OTR) microwave oven in accordance with the present invention will be described in detail with reference to one embodiment illustrated in the accompanying drawings.

There can be a plurality of embodiments an Over-the-Range microwave oven in accordance with the present invention, and, hereinafter, the most preferable embodiment will be described.

Hereinafter, embodiments of the present invention will be described in detail with reference to the accompanying drawings.

Figure 1:
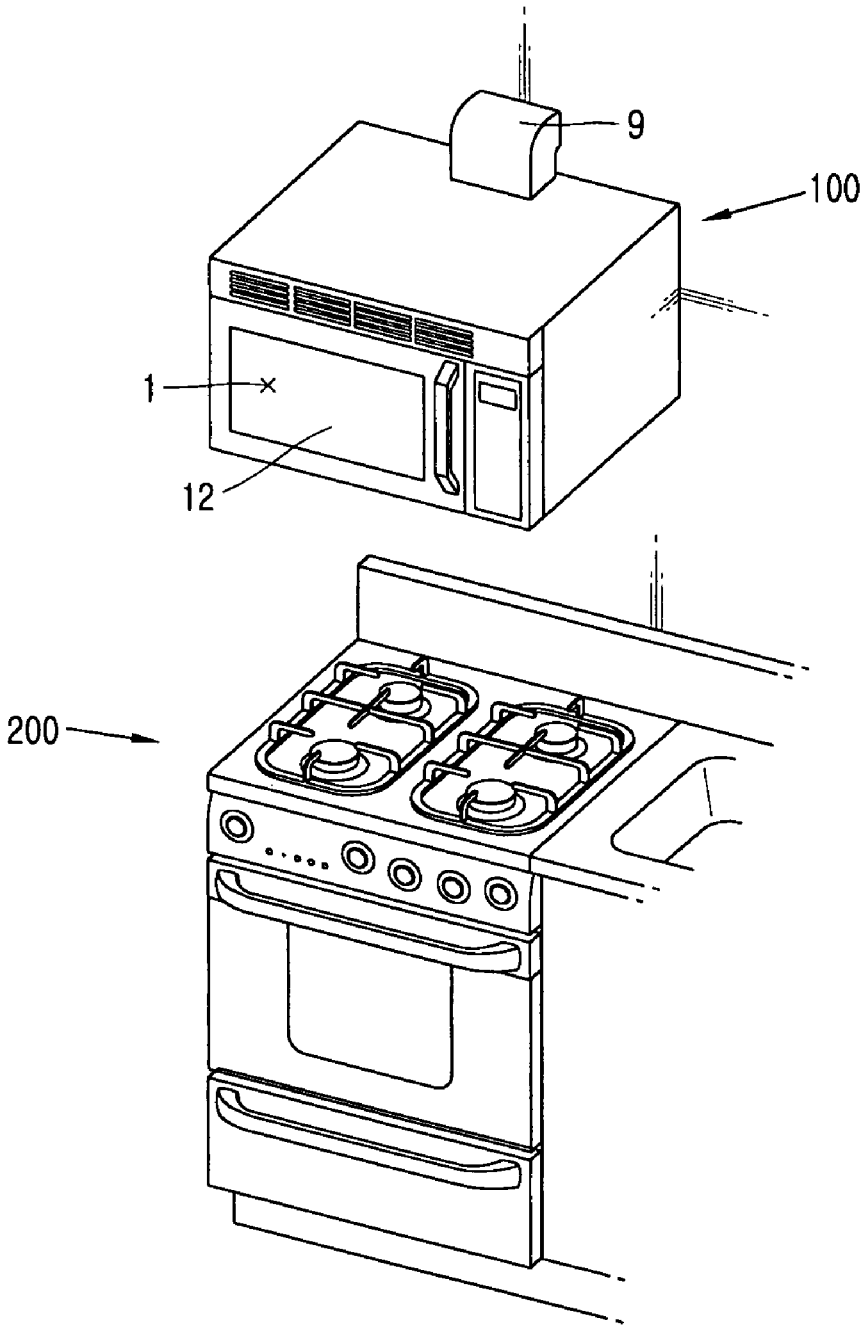
FIG. 1 CONVENTIONAL ART
FIGS. 1 and 2 are perspective views illustrating an over-the-hood (OTR) microwave oven in accordance with the conventional art.
Figure 2:
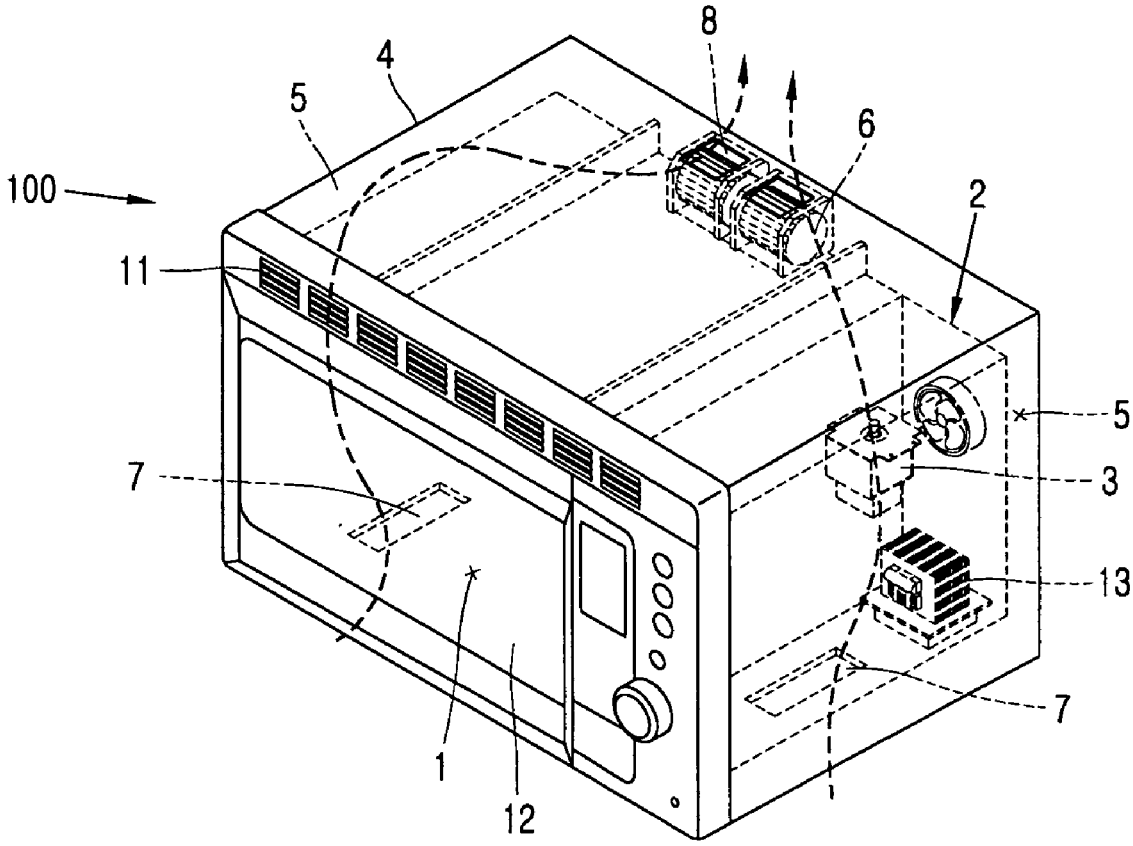
FIG. 2 CONVENTIONAL ART
Figure 3:
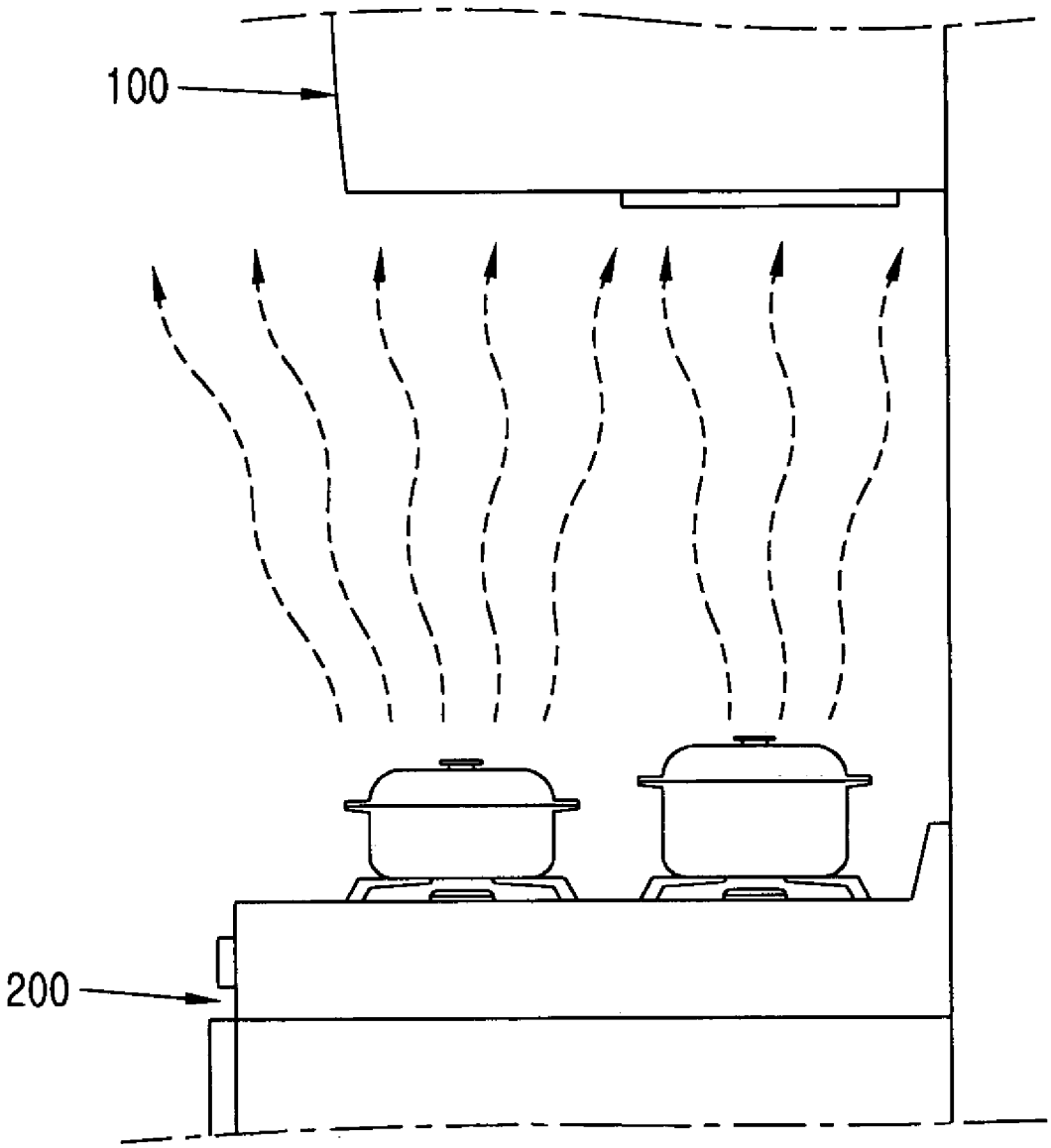
FIG. 3 CONVENTIONAL ART
FIG. 3 is a sectional view illustrating an operation of the conventional OTR microwave oven.
Figure 4:
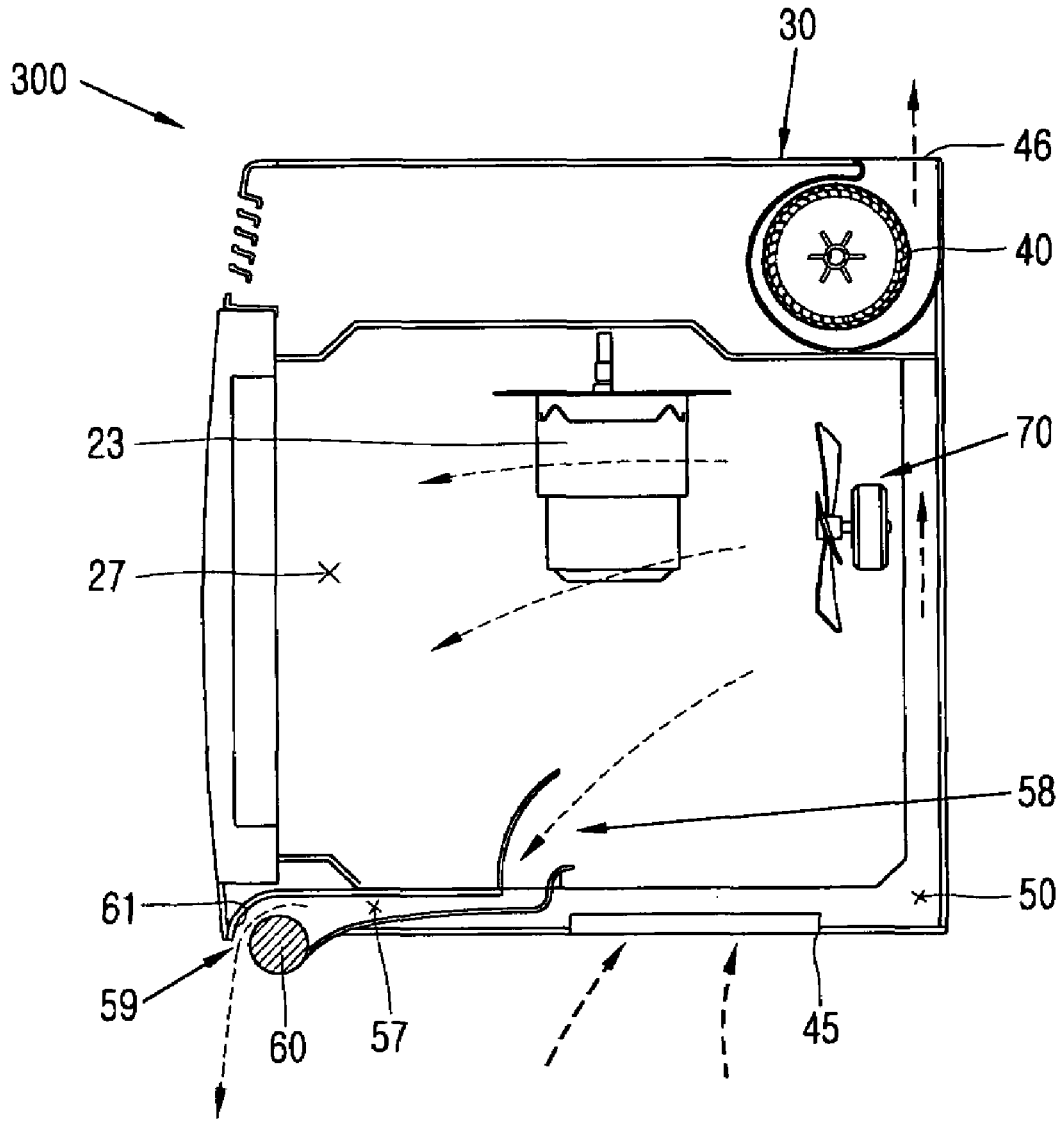
FIG. 4 is a side sectional view of an OTR microwave oven in accordance with one embodiment of the present invention.

FIG. 4 is a side sectional view clearly illustrating particular components of an OTR microwave oven in accordance with one embodiment of the present invention. Since other constructions of the OTR microwave oven are the same as those in the conventional art, a detailed drawing therefor will be omitted.

As illustrated therein, an OTR microwave oven 300 in accordance with one embodiment of the present invention includes: a main body 30 installed above a cooking source of a gas range 200 and having therein a cavity (not illustrated) and an electric equipment chamber 27 in which a magnetron 3 is located; an air exhaust path 50 formed inside the main body 30 to thereby provide a path through which air generated from the cooking source and introduced through a suction port 45 formed at the bottom of the main body 30 is discharged to the outside through a discharge port 46 formed at an upper side of the main body; and an airstream guide path 57 formed inside the main body 30 to thereby provide a path through which air inside the electric equipment chamber 27 is discharged to a front end portion of the main body 30 by a flow generating apparatus provided inside the electric equipment chamber 27 in order to guide air from the cooking source to the suction port 45.

The airstream guide path 57 is formed at the bottom of the main body such that an inlet 58 thereof is formed at the bottom of the electric equipment chamber 27 and an outlet 59 thereof is formed at the front end portion of the bottom of the main body 30.

The outlet 59 of the airstream guide path 57 is extended in a longitudinal direction of the front end portion of the bottom of the main body 30 such that air flowing from the electric equipment chamber 27 is exhausted via the entire front end portion of the bottom of the main body 30.

Meanwhile, an airstream guide unit 60 is formed at a lower end of the outlet 59 of the airstream guide path 57 in order to guide a direction of the air coming out through the airstream guide path 57. A slit 61 is formed between the airstream guide unit 60 and an upper end of the outlet 59 of the airstream guide path 57.

The airstream guide unit 60 is extended along the longitudinal direction of the front end portion of the bottom of the main body 30, and a cylindrical member whose cross section is circular is used therefor.

In addition, an upper side of the outlet 59 of the airstream guide path 57 has a certain radius of curvature such that air being discharged flows downwardly of the main body 30, that is, in a direction where the gas range 200 is located. At this time, the radius of curvature of the upper side of the outlet 59 is the same as that of the airstream guide unit 60, preferably, for smooth airstream.

Meanwhile, as the flow generating apparatus installed inside the electric equipment chamber 27, as illustrated in FIG. 4, a cooling fan 70 installed inside the electric equipment chamber 27 is used to cool the magnetron 23.

Here, the inlet 58 of the airstream guide path 57 has a certain radius of curvature and is protrudingly extended to thereby help exhaust air generated by the cooling fan 70 effectively to the outside through the airstream guide path.

Figure 5:
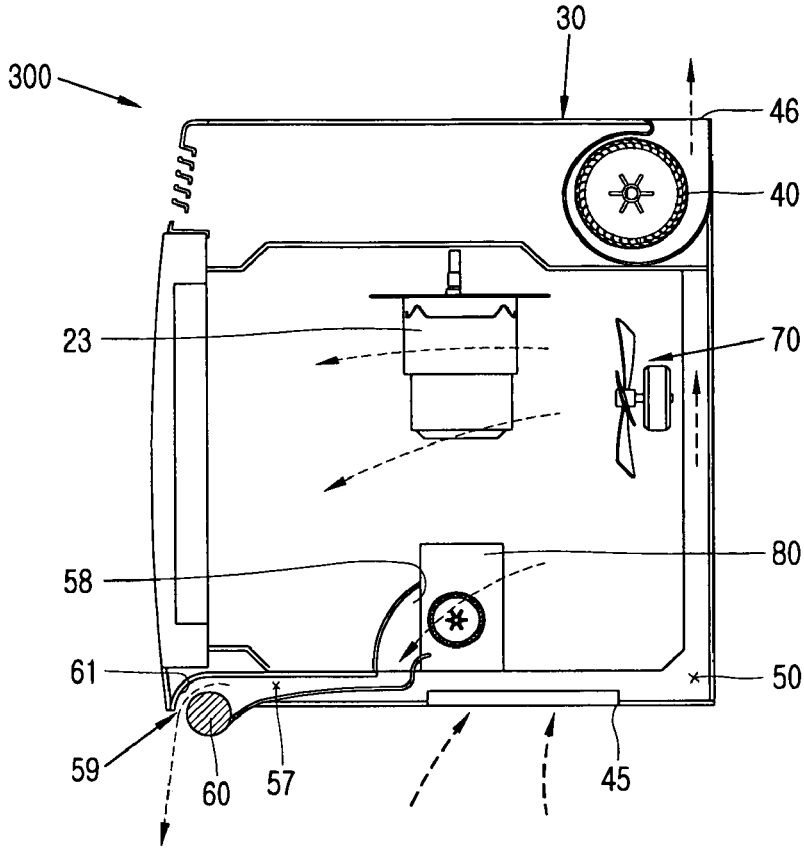
FIG. 5 is a side sectional view of important parts of the OTR microwave oven in accordance with another embodiment of the present invention.

FIG. 5 is a side sectional view of main particular units of an OTR microwave oven in accordance with another embodiment of the present invention.

As illustrated therein, an auxiliary flow generating apparatus 80 is further included in order to more efficiently exhaust air inside the electric equipment chamber 27 through the airstream guide path 57.

The auxiliary flow generating apparatus 80 is preferably installed inside the electric equipment chamber 27 and at the inlet 58 side of the airstream guide path 57, and comprises a fan motor such as a separate centrifugal fan or a cross flow fan.

Figure 6:
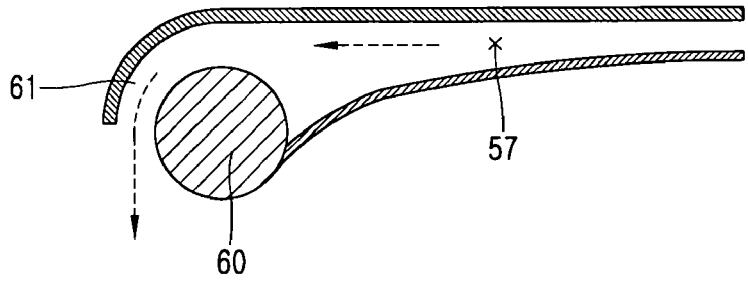
FIGS. 6 and 7 are sectional views illustrating important parts of an OTR microwave oven of the present invention.
Figure 7:
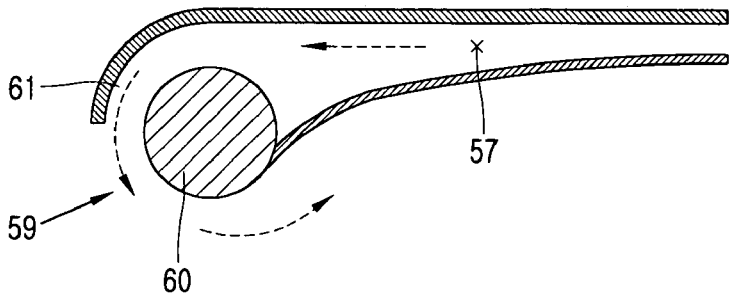

FIGS. 6 and 7 illustrate how air flows through the airstream guide path 57, a main part of the OTR microwave oven 300 in accordance with the present invention. As illustrated in FIG. 6, if flow velocity of air exhausted to the outside from the electric equipment chamber 27 through the airstream guide path 57 is very high, air is sprayed downwardly of the main body 30, that is, in a direction where the gas range 200 is located, passing the slit 61 of the outlet 59 of the airstream guide path 57.

In addition, if the flow of the air exhausted to the outside from the electric equipment chamber 27 through the airstream guide path 57 is maintained within an appropriate velocity range, as illustrated in FIG. 7, a flow is generated at a side of the suction port 45 formed at the bottom of the main body 30 along an outer circumferential surface of the airstream guide unit 60 by the Coanda-effect while air passes through the slit 61 of the side of the outlet 59 of the airstream guide path 57.

Hereinafter, an operation of the OTR microwave oven in accordance with the present invention will be described. Here, since a cooking process, the original function of the microwave oven, is the same as that in the conventional art, a description therefor will be omitted. A hood function will be described in detail.

If the user pushes the hood operation button on the operation panel, the blower 40 installed inside the microwave oven 300 is operated to generate a suction force, by which combustion gas and pollution air generated when the user cooks using the gas range installed under the microwave oven 200 through the air suction port 45 formed at the bottom of the main body 30. The sucked air is exhausted to the outside via the air exhaust path 50 through the air discharge port 46 formed at an upper surface of the main body 30, whereby the microwave oven serves as the hood for ventilating smoke or smell.

At the same time, by the operation of the cooling fan 70 or the auxiliary generating apparatus 80 inside the electric equipment chamber 27, air of the electric equipment chamber 27 passes the airstream guide path 57 and is discharged to the outside through the airstream guide unit 60 and the slit 61 which are formed at the outlet 59 formed at the front end portion of the bottom of the main body 30.

Figure 8:
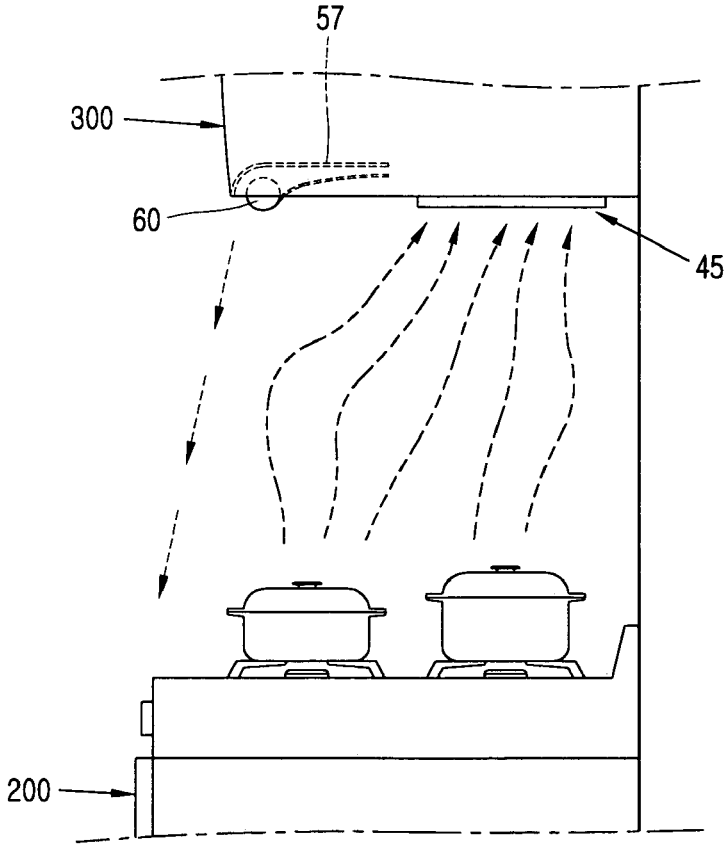
FIGS. 8 and 9 are cross-sectional views illustrating an operation of the OTR microwave oven of the present invention.

Here, if velocity of air discharged through the outlet 59 of the airstream guide path 57 is high, as illustrated in FIG. 8, air which passes the airstream guide path and then is discharged serves as an air curtain which is strongly discharged downwardly of the main body. Accordingly, of air generated from the cooking source of the gas range 200, some of the air which is not introduced through the suction port formed at the bottom of the main body but flows toward the front where a cook is located is blocked by the air curtain made of air inside the electric equipment chamber which is discharged through the airstream guide path, such that the air cannot flow toward the front where the cook is located but is induced to the suction port.

Figure 9:
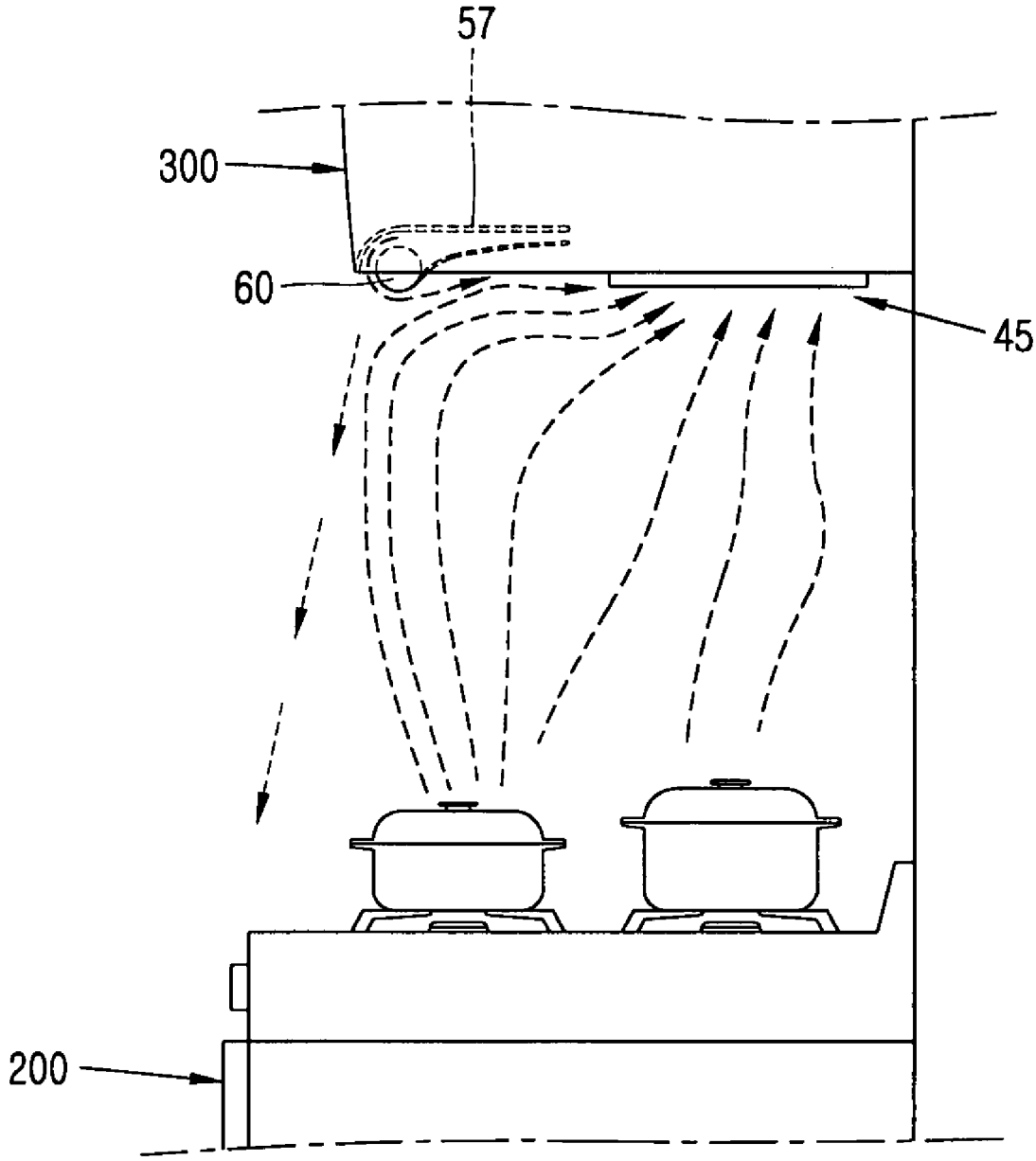

In addition, if velocity of the air discharged through the outlet 59 of the airstream guide path 57 is within an appropriate range, as illustrated in FIG. 9, air discharged through the slit 61 of the outlet 59 flows along the airstream guide unit 60 by the Coanda-effect and therefore negative pressure is formed around the airstream guide unit 60. Accordingly, of air generated from the cooking source of the gas range 200, some of the air which is not introduced through the suction port formed at the bottom of the main body but flows toward the front where a cook is located is induced to the suction port 45 by a pressure difference formed around the airstream guide unit 60.

As described so far, the OTR microwave oven of the present invention can effectively collect air containing cooking by-products generated from a cooking source which flows out toward the front of the OTR microwave oven where the cook is located, and can increase collection efficiency even when air containing cooking by-products is exhausted at a low velocity.

Accordingly, the present invention can obtain delightfulness of a cooking environment by blocking air containing cooking by-products which used to flow toward the face of the cook, thereby improving product reliability and competitiveness.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An over-the-range (OTR) microwave oven comprising:

a main body for installation above a cooking source of a gas range and having therein a cavity and an electric equipment chamber in which a magnetron is located;

an air exhaust path installed inside the main body and providing a path through which air generated from the cooking source which is introduced through a suction port formed at the bottom of the main body by a suction force of a blower installed at the main body is exhausted to the outside of the main body;

an airstream guide path installed inside the main body and providing a path through which air inside the electric equipment chamber is discharged to a front end portion of the bottom of the main body by a flow generating apparatus installed inside the electric equipment chamber in order to guide air from the cooking source to the suction port, the airstream guide path having an inlet formed at the bottom of the electric equipment chamber and an outlet thereof formed at the front end portion of the bottom of the main body;

an airstream guide unit having a circular cross-section formed at a lower end of the outlet of the airstream guide path; and a slit formed between the airstream guide unit and an upper end of the outlet of the airstream guide path.

2. The OTR microwave oven of claim 1, wherein the outlet is extended in a longitudinal direction of the front end portion of the bottom of the main body.

3. The OTR microwave oven of claim 1, wherein the flow generating apparatus is a cooling fan installed inside the electric equipment chamber in order to cool the magnetron.

4. The OTR microwave oven of claim 1, wherein the airstream guide unit is extended in a longitudinal direction of the front end portion of the bottom of the main body.

5. The OTR microwave oven of claim 1, wherein an upper side of the outlet of the airstream guide path has a certain radius of curvature such that air being discharged flows downwardly of the main body.

6. The OTR microwave oven of claim 1, wherein the inlet of the airstream guide path is protrudingly extended in a direction where the flow generating apparatus is installed.

7. The OTR microwave oven of claim 1, wherein an auxiliary flow generating apparatus is installed inside the electric equipment chamber and at the inlet side of the airstream guide path.

8. The OTR microwave oven of claim 7, wherein the auxiliary flow generating apparatus is a fan motor.

9. An over-the-range (OTR) microwave oven comprising:

a main body for installation above a cooking source of a gas range, the main body having therein a cavity and an electric equipment chamber in which a magnetron is located;

a suction port formed at the bottom of the main body;

a blower installed at the main body;

a flow generating apparatus installed inside the electric equipment chamber;

an air exhaust path installed inside the main body and providing a path through which air generated from the cooking source which is introduced through the suction port formed at the bottom of the main body by a suction force of the blower installed at the main body is exhausted to the outside of the main body; and an airstream guide path installed inside the main body and providing a path through which air inside the electric equipment chamber is discharged to a front end portion of the bottom of the main body by the flow generating apparatus installed inside the electric equipment chamber in order to guide air from the cooking source to the suction port, the airstream guide path having an inlet formed at the bottom of the electric equipment chamber and an outlet thereof formed at the front end portion of the bottom of the main body, wherein the inlet of the airstream guide path protrudingly extends towards the flow generating apparatus.

10. The OTR microwave oven of claim 9, wherein the airstream guide path is formed at the bottom of the main body.

11. The OTR microwave oven of claim 9, wherein the outlet is extended in a longitudinal direction of the front end portion of the bottom of the main body.

12. The OTR microwave oven of claim 9, wherein the flow generating apparatus is a cooling fan installed inside the electric equipment chamber in order to cool the magnetron.

13. The OTR microwave oven of claim 9, wherein an airstream guide unit is formed at a lower end of the outlet of the airstream guide path and a slit is formed between the airstream guide unit and an upper end of the outlet of the airstream guide path.

14. The OTR microwave oven of claim 13, wherein the airstream guide unit is extended in a longitudinal direction of the front end portion of the bottom of the main body.

15. The OTR microwave oven of claim 13, wherein the airstream guide unit has a circular cross section.

16. The OTR microwave oven of claim 13, wherein an upper side of the outlet of the airstream guide path has a certain radius of curvature such that air being discharged flows downwardly of the main body.

17. The OTR microwave oven of claim 13, wherein an auxiliary flow generating apparatus is installed inside the electric equipment chamber and at the inlet side of the airstream guide path.

18. The OTR microwave oven of claim 17, wherein the auxiliary flow generating apparatus is a fan motor.

* * * * *